US006988488B2

(12) United States Patent
Pursifull et al.

(10) Patent No.: US 6,988,488 B2
(45) Date of Patent: Jan. 24, 2006

(54) FUEL PRESSURE RELIEF VALVE

(75) Inventors: Ross D. Pursifull, Dearborn, MI (US); David R. Gimby, Livonia, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 13 days.

(21) Appl. No.: 10/655,863

(22) Filed: Sep. 5, 2003

(65) Prior Publication Data

US 2004/0206338 A1 Oct. 21, 2004

Related U.S. Application Data

(60) Provisional application No. 60/462,974, filed on Apr. 15, 2003.

(51) Int. Cl.
*F02M 37/04* (2006.01)

(52) U.S. Cl. ..... 123/467; 123/514

(58) Field of Classification Search ..... 123/467, 123/514, 510, 506; 137/512, 512.1, 539.5, 137/493.8

See application file for complete search history.

(56) References Cited

U.S. PATENT DOCUMENTS

| | | | | | |
|---|---|---|---|---|---|
| 2,090,781 | A | | 8/1937 | Camner | 103/41 |
| 2,234,924 | A | | 3/1941 | Green | 103/42 |
| 2,915,335 | A | * | 12/1959 | Barnes | 301/37.22 |
| 3,742,926 | A | * | 7/1973 | Kemp | 123/467 |
| 4,556,077 | A | | 12/1985 | Peyton | 137/112 |
| 4,648,369 | A | | 3/1987 | Wannenwetsch | 123/467 |
| 4,709,680 | A | * | 12/1987 | Turchi et al. | 123/467 |
| 4,938,254 | A | | 7/1990 | Gimby | 137/541 |
| 4,989,590 | A | * | 2/1991 | Baum et al. | 601/163 |
| 5,044,389 | A | | 9/1991 | Gimby | 137/39 |
| 5,183,087 | A | | 2/1993 | Aubel et al. | 141/59 |
| 5,244,022 | A | | 9/1993 | Gimby | 141/301 |
| 5,339,785 | A | * | 8/1994 | Wilksch | 123/457 |
| 5,361,742 | A | * | 11/1994 | Briggs et al. | 123/506 |
| 5,365,906 | A | * | 11/1994 | Deweerdt | 123/467 |
| 5,413,137 | A | | 5/1995 | Gimby | 137/200 |
| 5,477,829 | A | * | 12/1995 | Hassinger et al. | 123/467 |
| 5,572,974 | A | | 11/1996 | Wakeman | 123/497 |
| 5,623,910 | A | | 4/1997 | Riggle | |
| 5,638,786 | A | | 6/1997 | Gimby | 123/198 |
| 5,749,345 | A | | 5/1998 | Treml | 123/456 |
| 6,305,413 | B1 | | 10/2001 | Fischer et al. | 137/493.8 |
| 6,488,006 | B2 | | 12/2002 | Pursifull | 123/339.25 |
| 6,502,557 | B2 | | 1/2003 | Moroto et al. | 123/506 |
| 6,553,817 | B1 | | 4/2003 | Kotwicki et al. | 73/118.1 |
| 6,575,427 | B1 | | 6/2003 | Rauch et al. | 251/69 |
| 6,622,701 | B2 | * | 9/2003 | Endo | 123/467 |
| 2001/0025629 | A1 | | 10/2001 | Kiowsky et al. | 123/510 |

FOREIGN PATENT DOCUMENTS

| | | |
|---|---|---|
| GB | 1179357 | 1/1970 |

* cited by examiner

*Primary Examiner*—Carl S. Miller
(74) *Attorney, Agent, or Firm*—Brinks Hofer Gilson & Lione

(57) ABSTRACT

A fuel pressure relief valve is provided to minimize evaporative emissions due to fuel leakage through the fuel injectors. The fuel pressure relief valve is sealed during operation to prevent flow through the valve. When the automotive vehicle is not operating and the temperature has cooled, the valve unseals. Thereafter, temperature rises that would otherwise result in pressure buildup are prevented.

22 Claims, 7 Drawing Sheets

FUEL PRESSURE RELIEF VALVE

This application claims the benefit of U.S. Provisional Application No. 60/462,974, filed Apr. 15, 2003.

BACKGROUND

The present invention relates generally to fuel delivery systems, and more particularly to a fuel valve.

Several known government standards exist for measuring the amount of evaporative emissions that an automotive vehicle emits during time periods of non-operation. Examples of such government standards are those issued by the Environmental Protection Agency and the California Air Resources Board. In order to measure evaporative emissions, one common test involves operating an automotive vehicle until the vehicle reaches normal operating temperature. The automotive vehicle is then turned off and moved into a sealed chamber. Next, a set of chemical sensors measure the amount and type of emissions released by the vehicle over a time period of several days. During the time period that the emissions are being measured, typical environmental conditions are duplicated, such as the diurnal temperature cycle of rising ambient temperature during the middle of the day and the falling ambient temperature at night.

One source of emissions is fuel leakage from the fuel delivery system. Typically, when fuel leaks from the fuel delivery system, the leaked fuel turns to a vapor and is thus sensed by the chemical sensors during evaporative emissions tests. As a result, fuel leakage from the fuel delivery system has a negative impact on automotive manufacturers efforts to satisfy the evaporative emissions standards currently issued and any future standards that might be issued by the Environmental Protection Agency and the California Air Resources Board.

Fuel leakage typically occurs because the fuel delivery system remains pressurized after the automotive vehicle is turned off. Maintaining fuel pressure in the fuel delivery system after a vehicle is turned off is a common practice of automotive manufacturers in order to keep the fuel system ready to quickly restart the engine. There are several desirable reasons for keeping the fuel system filled with fuel during periods of non-operation. Those reasons include minimizing emissions during restart and avoiding annoying delays in restarting. However, because the fuel remains pressurized, fuel leaks from various components in the fuel delivery system. One common source of leakage is through the fuel injectors, which are used in most automotive fuel systems. Fuel can also leak by permeation through various joints in the fuel delivery system.

Fuel leakage is particularly exacerbated by diurnal temperature cycles. During a typical day, the temperature rises to a peak during the middle of the day. In conjunction with this temperature rise, the pressure in the fuel delivery system also increases, which results in leakage through the fuel injectors and other components. This temperature cycle repeats itself each day, thus resulting in a repeated cycle of fuel leakage and evaporative emissions.

Accordingly, a system that maintains fuel in the fuel delivery system after the automotive vehicle is turned off while minimizing fuel pressure buildup is needed in order to minimize evaporative emissions.

BRIEF SUMMARY

A fuel pressure relief valve is provided to minimize fuel leakage and evaporative emissions during diurnal cycles by preventing pressure buildup as the temperature of the fuel system rises. One version of the fuel pressure relief valve includes an excess flow valve and a back pressure relief valve. (In the art, relief valves and pressure regulators generally have similar functions and thus are considered herein to be alternative terminology.) The excess flow valve seals when fuel flow is generated by the fuel pump during operation of the automotive vehicle. When the automotive vehicle is turned off and the fuel pump is stopped, the excess flow valve unseals after the temperature cools and the fuel pressure drops. Thereafter, during diurnal cycles, a back pressure relief valve prevents pressure buildup by unsealing when the pressure exceeds a release pressure and re-sealing when below that pressure, thereby releasing a small amount of fuel to the fuel tank. One advantage of the fuel pressure relief valve is that it can be employed as an inexpensive passive valve without the need for electronics or a control system.

BRIEF DESCRIPTION OF SEVERAL VIEWS OF THE DRAWINGS

The invention, including its construction and method of operation, is illustrated diagrammatically in the drawings, in which.

DETAILED DESCRIPTION

Figure 1:
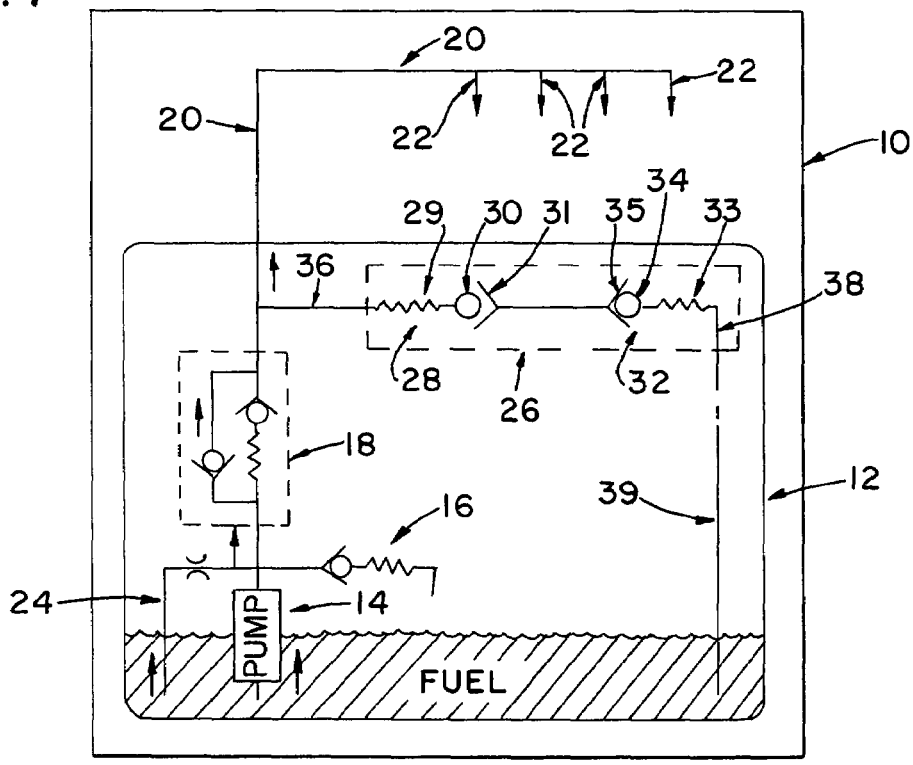
FIG. 1 is a schematic of a fuel delivery system with the invented fuel pressure relief valve.
Figure 2:
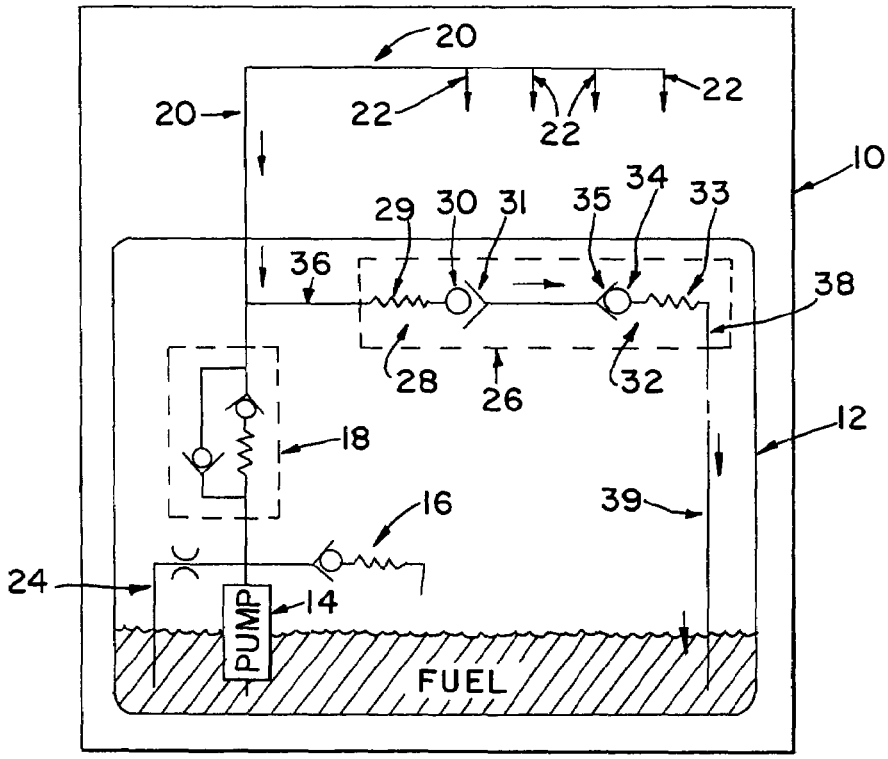
FIG. 2 is a schematic of the fuel delivery system of FIG. 1.

Turning now to the drawings, and particularly to FIGS. 1 and 2, a typical fuel delivery system 10 is shown. The fuel delivery system 10 is representative of typical fuel delivery systems used on automotive vehicles and includes a fuel tank 12, a fuel pump 14, a pump pressure relief valve 16, a parallel pressure relief valve 18, a fuel rail 20, and a series of fuel injectors 22. A typical parallel pressure relief valve consists of a 2.5 psi check valve and a 55 psi pressure relief valve. As those skilled in the art will readily appreciate, during operation the fuel pump 14 supplies fuel to the fuel manifold, or fuel rail 20, through the parallel pressure relief valve 18. The fuel is then injected into the intake manifold (not shown) of the engine through the fuel injectors 22. When the automotive vehicle is turned off, the fuel is maintained in a pressurized state in the fuel rail 20 by the parallel pressure relief valve 18. As described above, the pressurized fuel in the fuel rail 20 can result in undesirable fuel leakage through the fuel injectors 22, which results in evaporative emissions.

Figure 3:
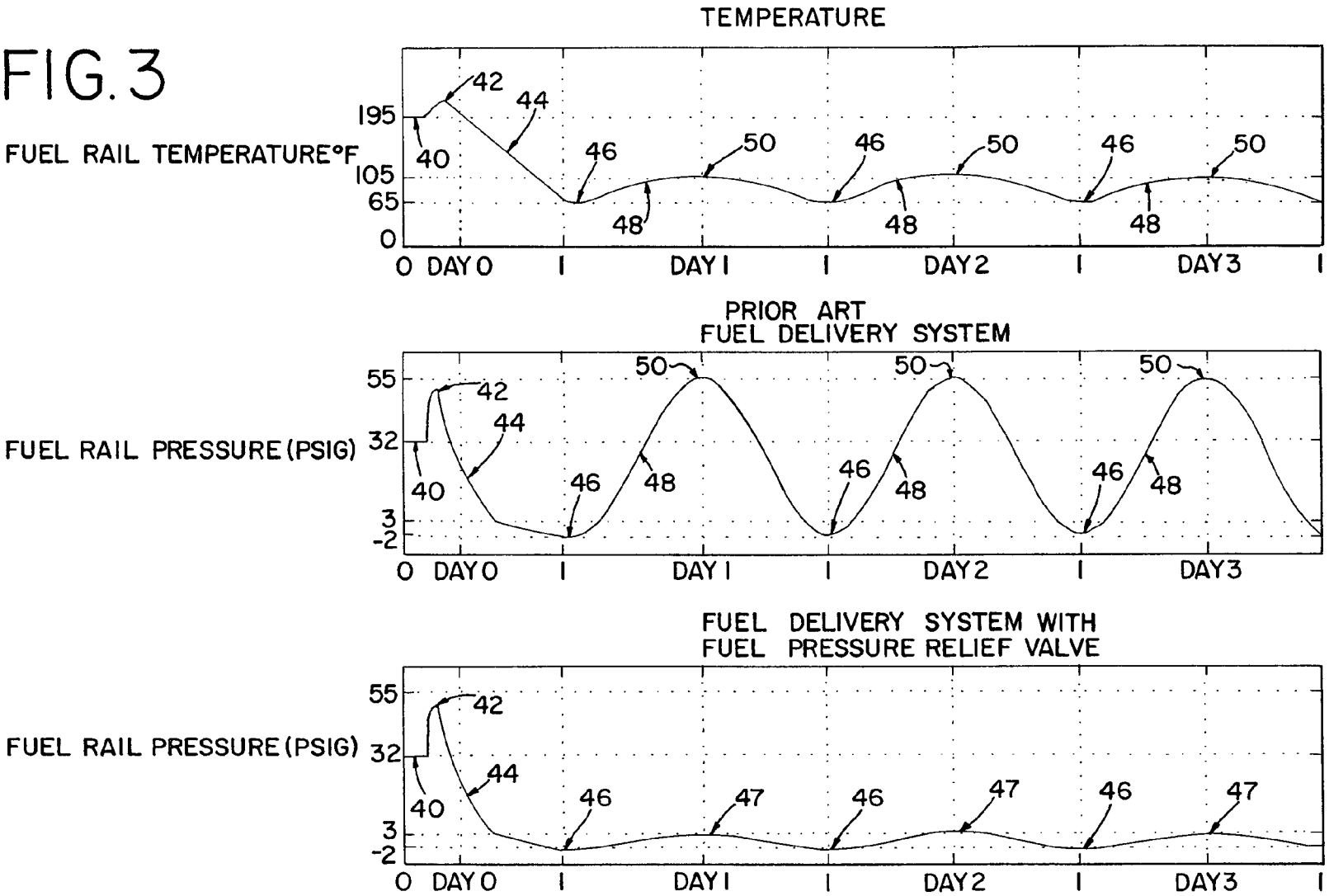
FIG. 3 is a graph showing a diurnal pressure cycle both with and without the invented fuel pressure relief valve.

As demonstrated in FIG. 3, fuel pressure buildup and leakage is exacerbated by diurnal temperature cycles. During operation of the automotive vehicle, the fuel pressure is maintained at about 40 to 80 psi above the intake manifold pressure by the fuel pump 14 and the temperature of the fuel rail 20 typically stays at about 195° F. (40). Immediately after the automotive vehicle is turned off, the temperature (and thus the fuel rail pressure) increase slightly due to the fact that the cooling systems of the automotive vehicle are no longer running (42). The temperature of the fuel rail 20 then slowly cools and the pressure in the fuel rail 20 consequently falls along with the temperature decrease (44).

Figure 4:
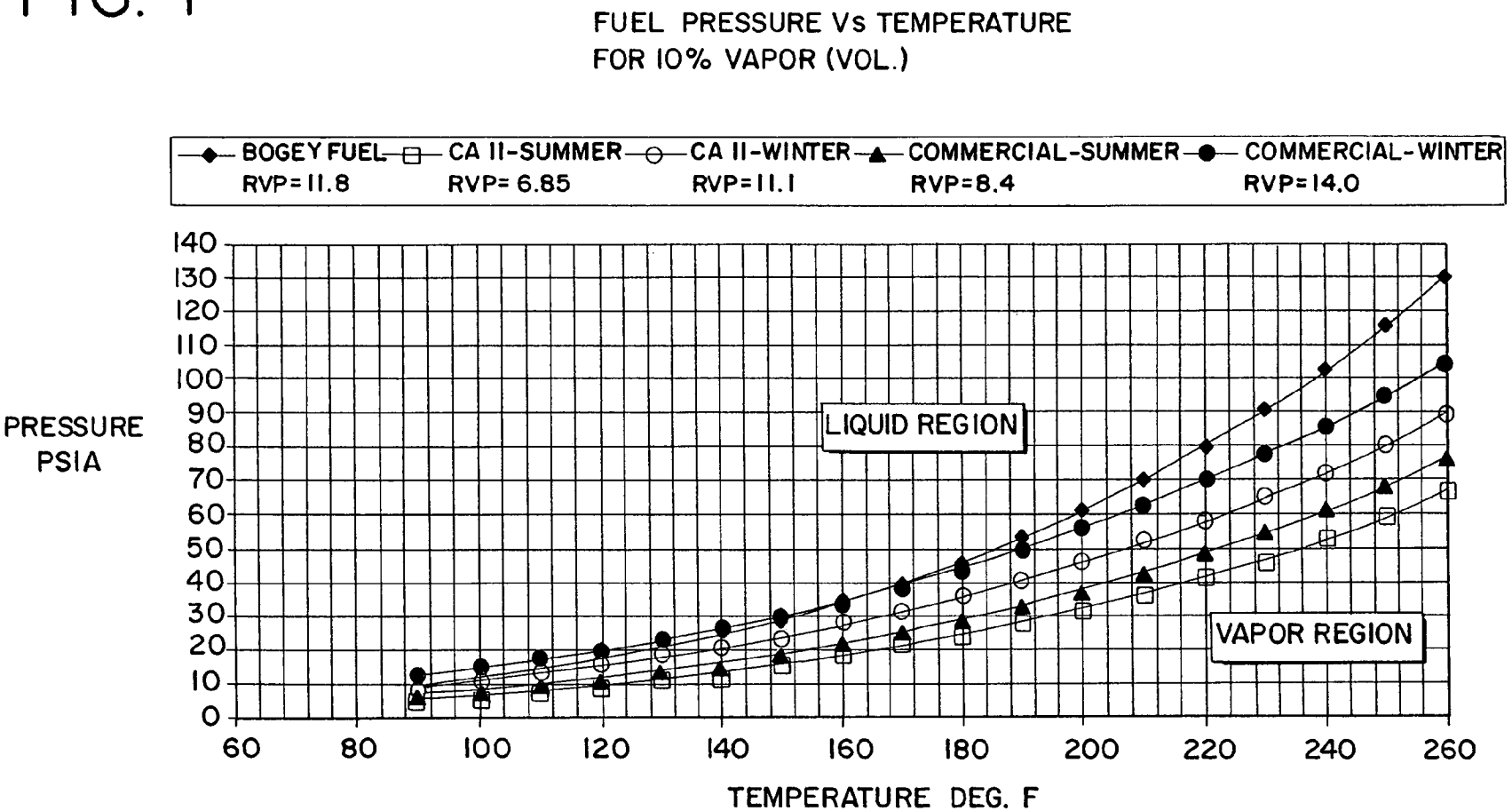
FIG. 4 is a graph showing fuel pressure versus temperature and the liquid-vapor curves of typical automotive fuels.

For reference, FIG. 4 shows the pressure versus temperature characteristics of typical automotive fuels and the resulting liquid-vapor curves. The area above each liquid-vapor curve represents pressure-temperature combinations at which various fuels are in an entirely liquid state. When liquid and vapor coexist, the pressure and temperature of the system are said to lie "on the line," i.e., are on the liquid-vapor curve. Thus, if there is a vapor space in the system, the pressure is determined by fuel temperature and fuel composition (i.e., the fuel type), assuming a single fuel temperature.

During the cool down stage, the volume of the fuel begins to contract. As shown in FIG. 1, the contracting fuel in the fuel rail 20 may draw up, or retrieve, additional fuel from either the fuel pump 14 or a fuel line 24 which terminates at the bottom of the fuel tank 12. On the other hand, if the fuel line 24 terminates above the bottom of the fuel tank 12, the contracting fuel may draw up fuel vapors into the fuel rail 20 instead. Eventually, the fuel rail temperature reaches a minimum value (typically 65° F.) which usually occurs when the diurnal cycle is at a minimum temperature during the night (46). At the same time, the fuel rail pressure reaches a corresponding minimum pressure (typically limited to −2.5 psi by the check valve in the parallel pressure relief valve 18) (46).

After the fuel rail temperature drops to the minimum temperature during the night, the temperature begins to increase again during the diurnal cycle of daytime warming. As the temperature of the fuel rail 20 increases, the pressure in the fuel rail 20 increases (48) until the temperature and pressure reach a maximum (typically 105° F.) which usually occurs in the middle of the day (50). In conventional fuel delivery systems, the pressure increase that occurs during the diurnal cycle causes fuel to leak through the fuel injectors 22, thereby contributing to evaporative emissions. This cycle is repeated each day until the automotive vehicle is restarted.

However, fuel leakage and evaporative emissions can be minimized by adding a fuel pressure relief valve 26 to the fuel delivery system 10. The fuel pressure relief valve 26 includes an excess flow valve 28 and a back pressure relief valve 32. In FIGS. 1 and 2, the fuel pressure relief valve 26 is shown with the excess flow valve 28 connected to an input 36 that is in open communication with the fuel pump 14 and the fuel rail 20. The back pressure relief valve 32 is then connected to the excess flow valve 28 in series, with the output 38 of the back pressure relief valve 32 being connected to a fuel line 39 that extends back to the fuel tank 12. In order to avoid leakage through the joints of the fuel pressure relief valve 26 by permeation, and in order to minimize the costs of the valve 26, the fuel pressure relief valve 26 is preferably located in the fuel tank 12 of the automotive vehicle. The fuel pressure relief valve 26 may be used in numerous fuel systems, including return fuel systems ("RFS"), mechanical returnless fuel systems ("MRFS"), and electronic returnless fuel systems ("ERFS"), although ERFS systems are illustrated herein.

Generally speaking, back pressure relief valves, sometimes referred to as back pressure regulators, open at pressures above a particular setting and seal for pressures below the setting. Back pressure relief valves have some flow sensitivity but typically regulate to a constant pressure regardless of flow characteristics. Often, back pressure relief valves are constructed with an elastomeric diaphragm so that a large surface area exists against which the controlled pressure may act. In contrast, pressure relief valves are typically of a more simple construction than back pressure relief valves. Pressure relief valves usually consist of a ball or poppet lifted off of a seat. Thus, pressure relief valves are more sensitive to flow characteristics. For this reason, once a pressure relief valve is unsealed, it can stay off the seat until the flow rate is low. To minimize this flow sensitivity, an orifice is often placed in series with the pressure relief valve. However, these valves often have large hysteresis. This means that they unseal at the set pressure but reseal at a pressure at least a few psi below the set pressure. Unless special care is taken to eliminate this hysteresis, the valve will not be suitable for some tasks.

Although the fuel pressure relief valve 26 may be embodied by several different structures, one possible version is shown in FIGS. 1 and 2. In this version, the excess flow valve 28 includes a spring 29 that biases a ball 30 away from a seat 31. Preferably, the excess flow valve 28 seals against the seat 31 when the fuel flow exceeds about 5 cc/sec and remains sealed until the input pressure drops below about 2 psi. The back pressure relief valve 32 includes a spring 33 that biases a ball 34 towards a seat 35. Preferably, the back pressure relief valve 32 remains sealed when the input pressure is less than about 3 psi and unseals when the input pressure exceeds about 3 psi.

Thus, it can now be seen that the fuel pressure relief valve 26 minimizes fuel pressure buildup and resulting fuel leakage and evaporative emissions when the automotive vehicle is not operating. When the automotive vehicle is turned on and the fuel pump 14 begins to supply fuel to the fuel rail 20, the excess flow valve 28 will experience a flow greater than the preferred 5 cc/sec shut-off flow. The excess flow valve 28 will then seal and stay sealed while the automotive vehicle operates. Therefore, throughout operation of the vehicle, the fuel flow to the back pressure relief valve 32 will be prevented by the excess flow valve 28.

When the automotive vehicle is turned off and the fuel pump 14 stops, the parallel pressure relief valve 18 maintains pressure in the fuel rail 20. As the fuel rail 20 cools and the pressure of the fuel drops, the excess flow valve 28 unseals when the pressure drops below the preferred 2 psi release pressure. The excess flow valve 28 then remains unsealed throughout the remaining time that the automotive vehicle is not operating. As shown in FIG. 2, now when the ambient temperature increases during the next diurnal cycle, fuel will be released through the back pressure relief valve 32 whenever the fuel rail pressure exceeds the preferred 3 psi release pressure. Thus, as shown in FIG. 3, the fuel rail pressure remains at a lower pressure throughout subsequent diurnal cycles (limited to about 3 psi by the back pressure relief valve 32) (47), while at the same time keeping the fuel rail 20 mostly filled with liquid fuel.

Figure 5:
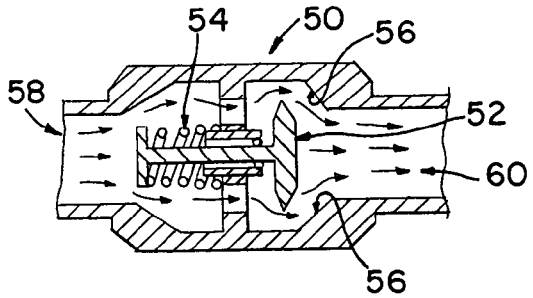
FIG. 5 is a side cross sectional view of an excess flow valve showing the valve unsealed.
Figure 6:
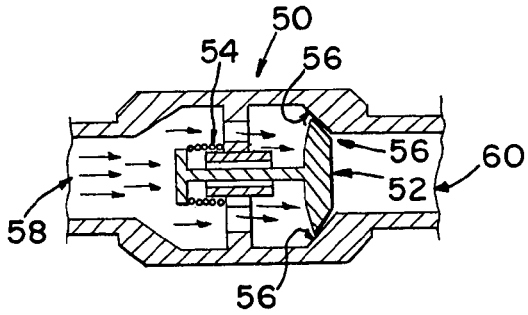
FIG. 6 is a side cross sectional view of the excess flow valve of FIG. 5 showing the valve sealed.

Turning now to FIGS. 5–10, various types of excess flow valves that may be used in the fuel pressure relief valve 26 are shown. FIG. 5 shows an excess flow valve 50 in an open position, in which the sealing member is a vane 52. The excess flow valve 50 also includes a spring 54 that biases the vane 52 away from the seat 56. In FIG. 5 a small amount of flow is shown passing from the input 58 to the output 60 of the valve 50 without closing the valve 50. In FIG. 6, the same valve 50 is shown with the vane 52 sealed against the seat 56 as a result of the flow exceeding the shut-off flow rate.

Figure 7:
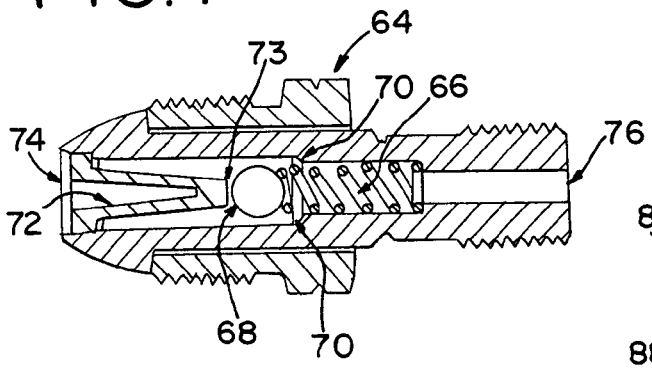
FIG. 7 is a side cross sectional view of another excess flow valve with a ball and a spring.

In FIG. 7, another excess flow valve 64 is shown. In this version of the excess flow valve 64, a spring 66 biases a ball 68 away from the seat 70. A filter member 72 with a stop portion 73 is installed in the input 74. The stop portion 23 thereby retains the ball 68 within the valve 64. Thus, when the flow from the input 74 exceeds the shut-off flow rate, the ball 68 seals against the seat 70 and prevents flow through the output 76.

Figure 8:
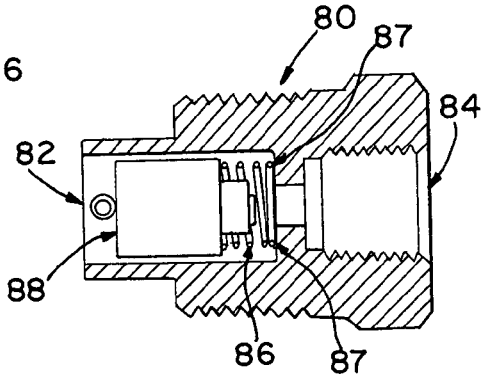
FIG. 8 is a side cross sectional view of another excess flow valve with a cylinder sealing member and a spring.

In FIG. 8, another excess flow valve 80 is shown which is similar to the version in FIG. 7. Thus, in this version, the input 82, output 84, spring 86 and seat 87 are similar to those shown in FIG. 7. However, in this version, the sealing member is a cylinder-shaped member 88, and the cylinder-shaped member 88 is retained with a roll pin 90.

Figure 9:
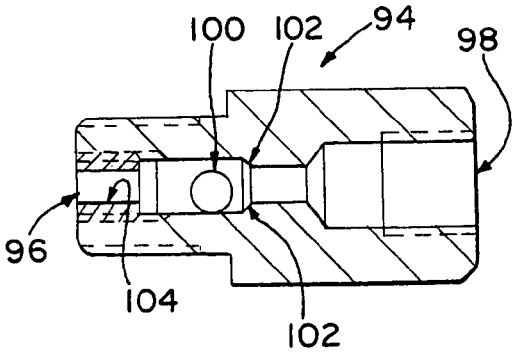
FIG. 9 is a side cross sectional view of another excess flow valve with a ball and without a spring.

In FIG. 9, another excess flow valve 94 is shown with an input 96 and an output 98. In this version, no spring is used to bias the ball 100 away from the seat 102. Instead, a spacer 104 traps the ball 100 between the spacer 104 and the seat 102. When the flow from the input 96 exceeds the shut-off flow rate, the ball 100 is pushed up against the seat 102. Then, when the pressure drops below the release pressure, the ball 102 falls away from the seat 102 as shown.

Figure 10:
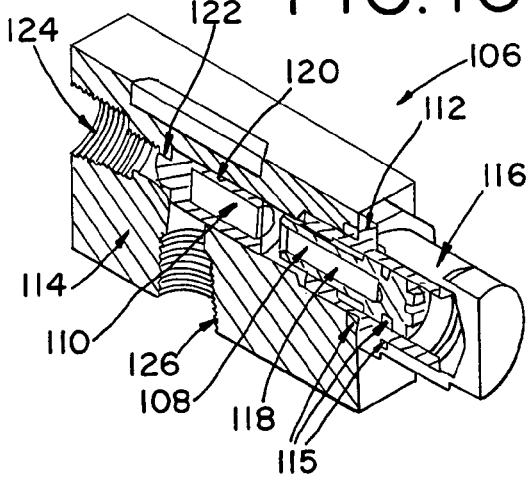
FIG. 10 is a side cross sectional view of another excess flow valve with a cylinder sealing member and magnets.

In FIG. 10, another excess flow valve 106 is shown. In this version, attracting magnets 108, 110 are used to unseal the valve 106. The adjustable stationary magnet 108 is mounted in an endplug 112. The endplug 112 is sealed with the body 114 to prevent leakage with o-rings 115 and a cover 116. The position of the stationary magnet 108 may then be adjusted with an adjusting screw 118. The moveable piston 120 includes a magnet 110, which is attracted towards the stationary magnet 108. An o-ring 122 is also included at the output 124 to seal the piston 120 in the closed position (as shown). Thus, in operation, fuel flows through the input 126 and creates a pressure differential across the piston 120 as the fuel flows to the output 124. When the pressure differential becomes high enough, the piston 120 moves towards the output 124 and restricts additional flow between the input 126 and the output 124. However, when the pressure equalizes between the input 126 and the output 124, the magnets 108, 110 pull the piston 120 away from the output 124, thus unsealing the valve 106.

Figure 11:
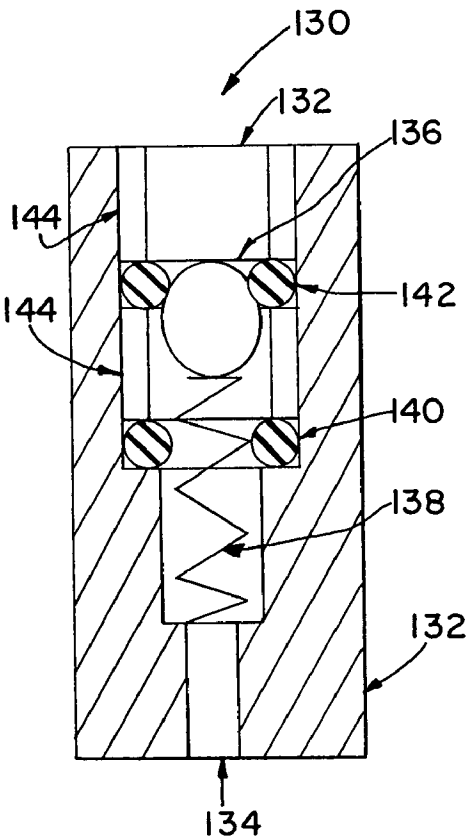
FIG. 11 is a side cross sectional view of one version of the invented fuel pressure relief valve.

Turning now to FIG. 11, a version of the fuel pressure relief valve 130 is shown, which may be more cost effective to manufacture since parts of the excess flow valve 28 and the back pressure relief valve 32 have been combined. In this version, the body 132 of the valve 130 is made from acetal and includes an input 132 and an output 134. A single ball 136 is used in the fuel pressure relief valve 130 and acts like a joined sealing member. A spring 138 is installed between the ball 136 and the output 134. The ball 136 is then trapped between two seats formed from viton o-rings 140, 142. Cylindrical acetal spacers 144 are pressed into the input 132 to position the o-rings 140, 142.

The function of the fuel pressure relief valve 136 in FIG. 11 is now apparent. When the fuel flow at the input 132 exceeds the shut-off flow rate, the ball 136 is pressed against the o-ring 140 adjacent the output 134 thereby sealing the valve 130. In this position, the valve 130 acts like the excess flow valves 28 previously described. When the pressure drops below a release pressure, the ball 136 is pushed away from the output o-ring 140 by the spring 138 and is pushed against the o-ring 142 adjacent the input 132. When the ball 136 is pressed against the input o-ring 142, the ball 136 again seals the valve 130. In this position, the valve 130 acts like the back pressure relief valve 32 previously described. Thus, when the pressure at the input 132 exceeds the release pressure, the ball 136 moves away from the input o-ring 142 and lets a small amount of fuel pass through the valve 130 to the output 134.

Figure 12:
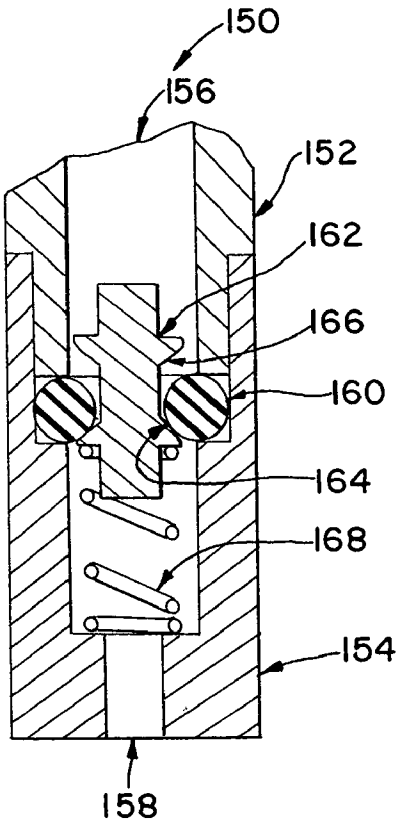
FIG. 12 is a side cross sectional view of another version of the invented fuel pressure relief valve.

Turning now to FIG. 12, another version of the fuel pressure relief valve 150 is shown. Like the version shown in FIG. 12, this version may be more cost effective since certain parts have been combined or eliminated. In this version, the body is made from two portions 152, 154 that are welded together with sonic welding. The first portion 152 includes the input 156, and the second portion 154 includes the output 158. A single o-ring 160 is trapped between the two portions 152, 154 of the body, thereby acting like joined seats. A poppet 162 with two joined vane surfaces 164, 166 is also trapped by the o-ring 160, which is positioned between the two vane surfaces 164, 166. A spring 168 is then installed between the poppet 162 and the output 158.

The function of the fuel pressure relief valve 150 in FIG. 12 is now apparent. When the fuel flow at the input 156 exceeds the shut-off flow rate, the poppet vane 162 adjacent the input 156 is pressed against the o-ring 160, thereby sealing the valve 150. In this position, the valve 150 acts like the excess flow valve 28 previously described. When the pressure drops below a release pressure, the poppet 162 is pushed away from the o-ring 160 by the spring 168, and the poppet vane 164 adjacent the output 158 is pushed against the o-ring 160. When the output poppet vane 164 is pressed against the o-ring 160, the poppet 162 again seals the valve 150. In this position, the valve 150 acts like the back pressure relief valve 32 previously described. Thus, when the pressure at the input 156 exceeds the release pressure, the output poppet vane 164 moves away from the o-ring 160 and lets a small amount of fuel pass through the valve 150 to the output 158.

Figure 13:
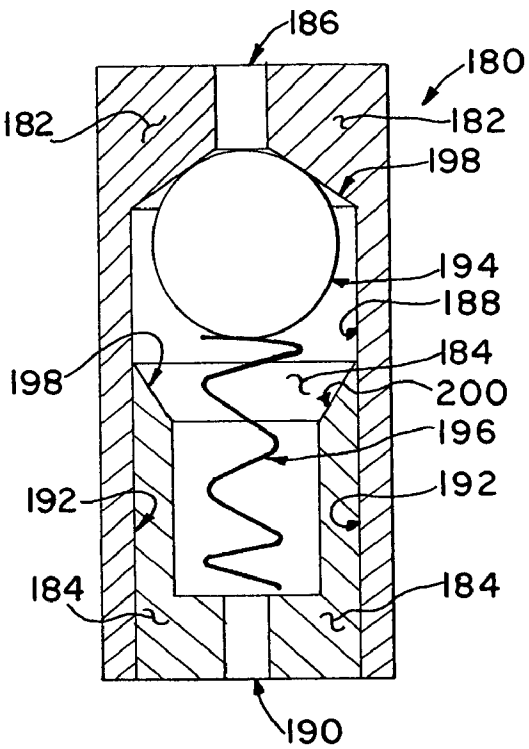
FIG. 13 is a side cross sectional view of another version of the invented fuel pressure relief valve.

Turning now to FIG. 13, another version of the fuel pressure relief valve 180 is shown. Like the versions shown in FIGS. 11 and 12, this version may be more cost effective since certain parts have been combined or eliminated. In this version, the body is made from two portions 182, 184. The first portion 182 includes the input 186 and an inner bore 188. The second portion 184 includes the output 190 and an outer bore 192 sized to fit within the inner bore 188 of the first portion 182. The first and second portions 182, 184 are affixed to each other through a press fit, welding, gluing or the like. A single ball 194 is used in the fuel pressure relief valve 180 and acts like a joined sealing member. The ball 194 is preferably made of viton. A spring 196 is installed between the ball 194 and the output 190. The ball 194 is trapped between one seat 198 formed in the first portion 182 and another seat 200 formed in the second portion 184.

The function of the fuel pressure relief valve 180 in FIG. 13 is now apparent. When the fuel flow at the input 186 exceeds the shut-off flow rate, the ball 194 is pressed against the output seat 200 in the second portion 184 thereby sealing the valve 180. In this position, the valve 180 acts like the excess flow valves 28 previously described. When the pressure drops below a release pressure, the ball 194 is pushed away from the seat 200 by the spring 196 and is pushed against the input seat 198 in the first portion 182. When the ball 194 is pressed against the seat 198, the ball 194 again seals the valve 180. In this position, the valve 180 acts like the back pressure relief valve 32 previously described. Thus, when the pressure at the input 186 exceeds the release pressure, the ball 194 moves away from the input seat 198 and lets a small amount of fuel pass through the valve 180 to the output 190.

Figure 15:
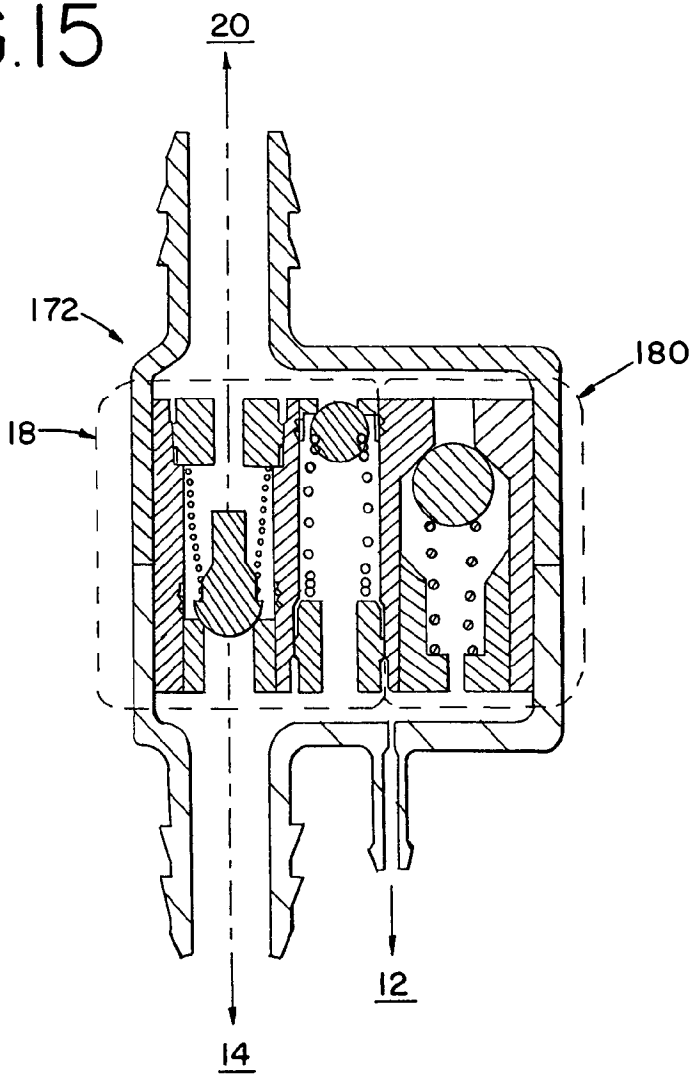
FIG. 15 is a side cross sectional view of a parallel pressure relief valve and the invented fuel pressure relief valve integrated into a single valve assembly.
Figure 14:
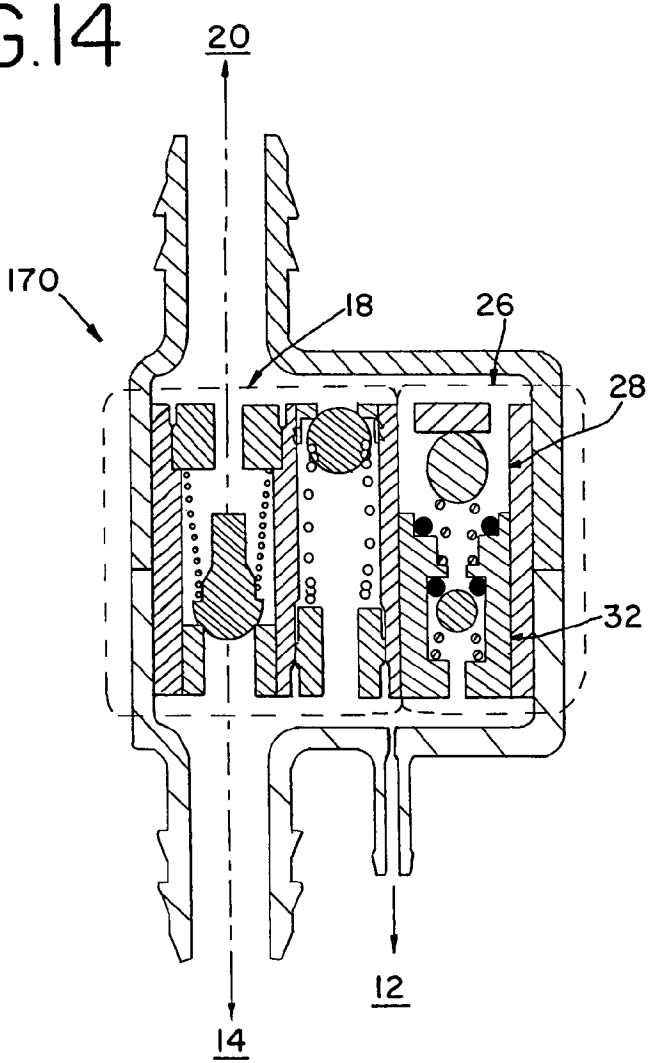
FIG. 14 is a side cross sectional view of a parallel pressure relief valve and the invented fuel pressure relief valve integrated into a single valve assembly.
Figure 17:
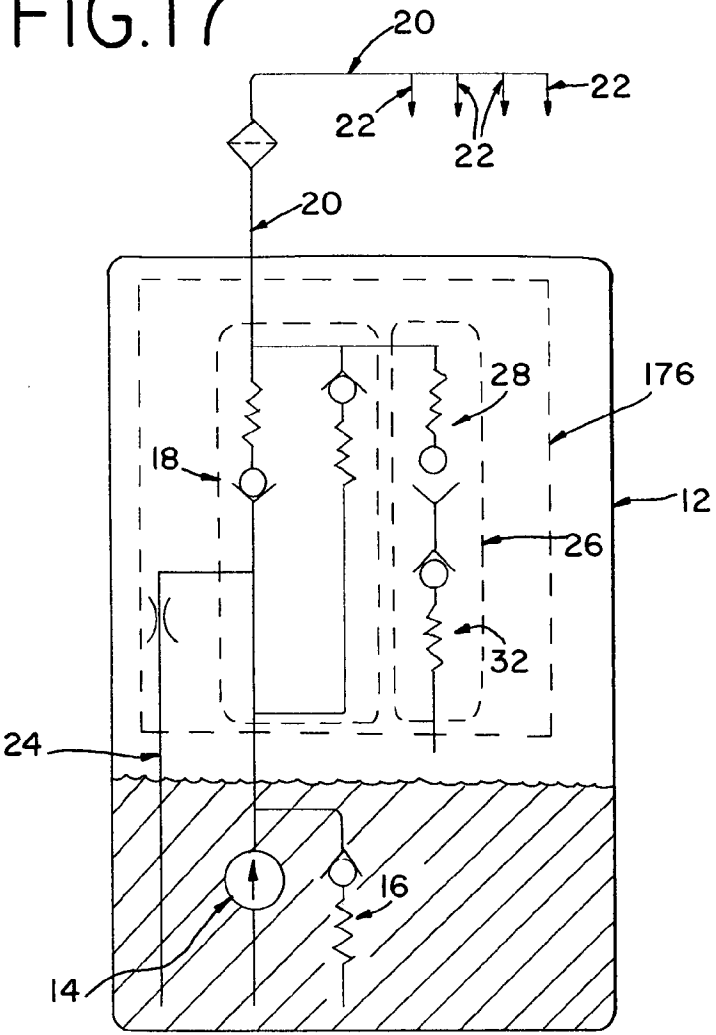
FIG. 17 is a schematic of a parallel pressure relief valve and the invented fuel pressure relief valve integrated into a single valve assembly.
Figure 16:
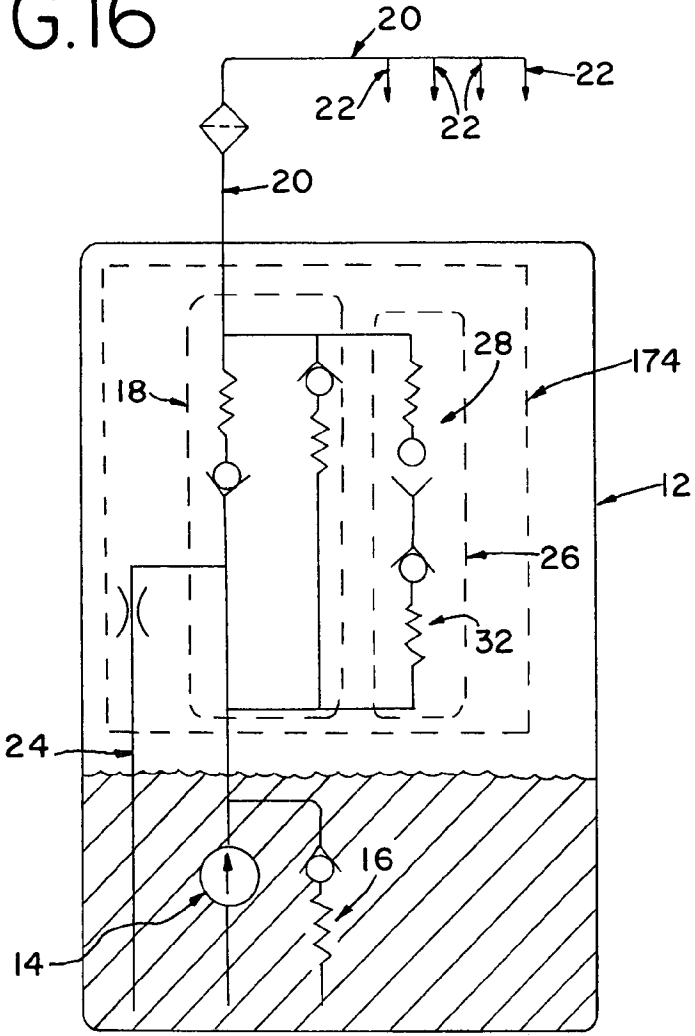
FIG. 16 is a schematic of a parallel pressure relief valve and the invented fuel pressure relief valve integrated into a single valve assembly.

Turning now to FIGS. 14–17, various versions of a single valve assembly are shown with the fuel pressure relief valve 26 integrated with the parallel pressure relief valve 18. In FIG. 14, the integrated valve assembly 170 is shown with a parallel pressure relief valve 18 on the left side of the valve assembly 170 and the fuel pressure relief valve 26 on the right side of the valve assembly 170. (The integrated valve assembly 174 shown in FIG. 16 is similar to this version). In this version, the fuel pressure relief valve 26 is connected to the pump 14 on one end and the fuel rail 20 on the other end. Thus, the excess flow valve 28 closes when the automotive vehicle is turned off and the pump 14 de-energizes. In FIG. 15, an integrated valve assembly 172 is shown using the fuel pressure relief valve 180 shown in FIG. 13 and described above. In FIG. 17, the integrated valve assembly 176 is shown with the fuel pressure relief valve 26 connected between the fuel rail 20 and the return fuel line 39. Thus, in this version the excess fuel valve 28 closes when the automotive vehicle is turned on and the pump 14 is energized. (FIG. 17 represents the same system schematic as shown in FIGS. 1 and 2.)

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

We claim:

1. A valve for a fuel delivery system, comprising:

an input in communication with a fuel pump and a fuel rail, wherein said fuel rail supplies fuel to an engine, said input being at one of an operating pressure, a first residual pressure, and a second residual pressure, said second residual pressure being above said first residual pressure;

a first sealing member and first seat, said first sealing member and said first seat abutting at said operating pressure and said first sealing member and said first seat being unsealed at said first and second residual pressures;

a second sealing member and a second seat, said second sealing member and said second seat abutting at said first residual pressure and said second sealing member and said second seat being unsealed at said second residual pressure; and wherein said first sealing member and said first seat are in communication with said second sealing member and said second seat, said abutting of said first sealing member and first seat preventing flow through said second sealing member and said second seat.

2. The valve according to claim 1, wherein said first sealing member, said first seat, said second sealing member and said second seat are disposed within a fuel tank.

3. The valve according to claim 1, in combination with a parallel pressure relief valve, wherein said first sealing member, said first seat, said second sealing member and said second seat are integrated into said parallel pressure relief valve, thereby forming a single valve assembly.

4. The valve according to claim 1, in combinatior with a fuel line in communication with said fuel rail, said fuel line terminating at a bottom of a fuel tank, wherein said fuel rail retrieves fuel from said fuel tank through said fuel line when fuel in said fuel rail is at a pressure below said second fuel pressure.

5. The valve according to claim 1, in combination with a fuel line in communication with said fuel rail, said fuel line terminating above a bottom of a fuel tank, wherein said fuel rail retrieves fuel vapor from said fuel tank through said fuel line when fuel in said fuel rail is at a pressure below said second fuel pressure.

6. The valve according to claim 1, further comprising a first spring; wherein said first spring biases said first sealing member away from said first seat, said first seat is disposed away from said input, and said first sealing member is disposed between said input and said first seat.

7. The valve according to claim 1, further comprising a second spring; wherein said second spring biases said second sealing member against said second seat, said second seat is disposed away from an output, and said second sealing member is disposed between said output and said second seal.

8. The valve according to claim 1, further comprising a first spring; wherein said first spring biases said first sealing member away from said first seat, said first seat is disposed away from said input, and said first sealing member is disposed between said input and said first seat; further comprising a second spring; wherein said second spring biases said second sealing member against said second seat, said second seat is disposed away from an output, and said second sealing member is disposed between said output and said second seat.

9. The valve according to claim 1, wherein said first sealing member and said second sealing member are joined as a single, unitary component.

10. The valve according to claim 1, wherein said first sealing member and said second sealing member are joined; further comprising a spring disposed between said joined first and second sealing members and an output; and wherein said first seat is disposed between said joined first and second sealing members and said output, and said second seat is disposed between said joined first and second sealing members and said input.

11. The valve according to claim 10, wherein said first sealing member, said first seat, said second sealing member and said second seat are disposed within a fuel tank.

12. The valve according to claim 11, in combination with a fuel line in communication with said fuel rail, said fuel line terminating at a bottom of a fuel tank, wherein said fuel rail retrieves fuel from said fuel tank through said fuel line when fuel in said fuel rail is at a pressure below said second fuel pressure.

13. The valve according to claim 12, in combination with a parallel pressure relief valve, wherein said first sealing member, said first seat, said second sealing member and said second seat are integrated into said parallel pressure relief valve, thereby forming a single valve assembly.

14. The valve according to claim 10, in combination with a parallel pressure relief valve, wherein said first sealing member, said first seat, said second sealing member and said second seat are integrated into said parallel pressure relief valve, thereby forming a single valve assembly.

15. The valve according to claim 1, wherein said first sealing member and said second sealing member are joined and wherein said first seat and said second seat are joined; further comprising a spring disposed between said joined first and second sealing members and an output; and wherein said joined first and second seats are disposed between said first sealing member and said second sealing member.

16. The valve according to claim 15, wherein said first sealing member, said first seat, said second sealing member and said second seat are disposed within a fuel tank.

17. The valve according to claim 16, in combination with a fuel line in communication with said fuel rail, said fuel line terminating at a bottom of a fuel tank, wherein said fuel line terminating at a bottom of a fuel tank, wherein said fuel rail retrieves fuel from said fuel tank through said fuel line when fuel in said fuel rail is at a pressure below said second fuel pressure.

18. The valve according to claim 17, in combination with a parallel pressure relief valve, wherein said first sealing member, said first seat, said second sealing member and said second seat are integrated into said parallel pressure relief valve, thereby forming a single valve assembly.

19. The valve according to claim 15, in combination with a parallel pressure relief valve, wherein said first sealing member, said first seat, said second sealing member and said second seat are integrated into said parallel pressure relief valve, thereby forming a single valve assembly.

20. The valve according to claim 1, wherein said first sealing member is a vane.

21. The valve according to claim 9, wherein said component is generally spherical, said first sealing member is a first portion of said component, and said second sealing member is a second portion of said component.

22. The valve according to claim 9, wherein said component is a poppet valve, said first sealing member is a first vane surface, and said second sealing member is a second vane surface.

* * * * *